US009273529B2

(12) United States Patent
Eddison et al.

(10) Patent No.: US 9,273,529 B2
(45) Date of Patent: Mar. 1, 2016

(54) DOWNHOLE PULSE GENERATING DEVICE

(71) Applicant: National Oilwell Varco, L.P., Houston, TX (US)

(72) Inventors: Alan Martyn Eddison, York (GB); Alan Kitching, Katy, TX (US); Derek Stuart, Aberdeenshire (GB)

(73) Assignee: National Oilwell Varco, L.P., Houston, TX (US)

( * ) Notice: Subject to any disclaimer, the term of this patent is extended or adjusted under 35 U.S.C. 154(b) by 270 days.

(21) Appl. No.: 14/026,482

(22) Filed: Sep. 13, 2013

(65) Prior Publication Data

US 2015/0075867 A1 Mar. 19, 2015

(51) Int. Cl.
*E21B 7/24* (2006.01)
*E21B 28/00* (2006.01)

(52) U.S. Cl.
CPC .. *E21B 28/00* (2013.01); *E21B 7/24* (2013.01)

(58) Field of Classification Search
CPC ..... E21B 7/24; E21B 21/10; E21B 28/00
See application file for complete search history.

(56) References Cited

U.S. PATENT DOCUMENTS

| | | | |
|---|---|---|---|
| 2,743,083 | A | 4/1956 | Zublin |
| 4,058,163 | A | 11/1977 | Yandell |
| 4,819,745 | A | 4/1989 | Walter |
| 5,871,051 | A | 2/1999 | Mann |
| 5,954,483 | A | 9/1999 | Tetzlaff |
| 6,089,832 | A | 7/2000 | Patterson |
| 6,279,670 | B1 | 8/2001 | Eddison et al. |
| 6,289,998 | B1 | 9/2001 | Krueger et al. |
| 6,439,318 | B1 | 8/2002 | Eddison et al. |
| 6,729,391 | B2 | 5/2004 | Hill et al. |
| 7,139,219 | B2 | 11/2006 | Kolle et al. |
| 7,201,222 | B2 | 4/2007 | Kanady et al. |
| 7,419,007 | B2 | 9/2008 | Belcher et al. |
| 8,113,278 | B2 * | 2/2012 | DeLaCroix et al. ..... 166/249 |
| 8,167,051 | B2 | 5/2012 | Eddison et al. |
| 8,181,719 | B2 * | 5/2012 | Bunney et al. ..... 175/56 |

(Continued)

FOREIGN PATENT DOCUMENTS

| | | |
|---|---|---|
| EP | 1682746 | 10/2003 |
| WO | 2005042916 | 5/2005 |
| WO | 2008007066 | 1/2008 |

OTHER PUBLICATIONS

International Preliminary Report on Patentability dated Dec. 8, 2014 for corresponding International Application No. PCT/US2013/0071997 (15 pgs.).

(Continued)

*Primary Examiner* — William P Neuder
(74) *Attorney, Agent, or Firm* — Derek V. Forinash; Porter Hedges LLP

(57) ABSTRACT

A pulse generator comprises a stator coupled to a housing and a rotor that is rotatably disposed within the housing. An annulus is formed between the rotor and the stator. An inner bore is formed through the rotor. One or more outer flow ports provide fluid communication between the annulus and the inner bore. A retrievable valve assembly is rotationally coupled to the rotor and at least partially disposed within the inner bore. The retrievable valve assembly includes a rotary valve member having one or more primary flow ports. A fluid flow path is periodically formed by the one or more outer flow ports, the annulus, and the one or more primary flow ports as the rotor rotates.

18 Claims, 3 Drawing Sheets

(56) References Cited

U.S. PATENT DOCUMENTS

| | | | |
|---|---|---|---|
| 2001/0054515 | A1 | 12/2001 | Eddison et al. |
| 2006/0060385 | A1 | 3/2006 | Amaudric et al. |
| 2006/0243493 | A1 | 11/2006 | El-Rayes et al. |
| 2007/0187112 | A1 | 8/2007 | Eddison et al. |
| 2008/0029268 | A1 | 2/2008 | Macfarlane |
| 2010/0212900 | A1 | 8/2010 | Eddison et al. |
| 2011/0073374 | A1 | 3/2011 | Bunney et al. |
| 2011/0094730 | A1 | 4/2011 | Johnson et al. |
| 2012/0127829 | A1 | 5/2012 | Sitka |
| 2012/0279724 | A1 * | 11/2012 | Eddison et al. ..... 166/374 |

OTHER PUBLICATIONS

Search Report and Written Opinion dated Feb. 25, 2014 for International Application No. PCT/US2013/071997 (10 pgs.).

Advertisment: drilformance.com: Accelglide 525-AG Specification Sheet: (2009).

* cited by examiner

DOWNHOLE PULSE GENERATING DEVICE

CROSS-REFERENCE TO RELATED APPLICATIONS

None

BACKGROUND

This disclosure relates generally to methods and apparatus for generating vibrations or fluid pulses with a downhole tool. More specifically, this disclosure relates to methods and apparatus that enable a downhole pulse generating device to generate pulses at a variety of frequencies and amplitudes.

Downhole pulse generating devices are used to create fluctuations in fluid pressure that create vibrations in the drill string. The vibrations or pulses can help prevent the build-up of solid materials around the drill string, which can reduce friction and prevent the drill string from becoming stuck in the well. Thus, the use of pulse generating devices can be useful in extending the operating range of drilling assemblies.

Thus, there is a continuing need in the art for methods and apparatus for generating downhole pulses that overcome these and other limitations of the prior art.

BRIEF SUMMARY OF THE DISCLOSURE

A pulse generator comprises a stator coupled to a housing and a rotor that is rotatably disposed within the housing. An annulus is formed between the rotor and the stator. An inner bore is formed through the rotor. One or more outer flow ports provide fluid communication between the annulus and the inner bore. A retrievable valve assembly is rotationally coupled to the rotor and at least partially disposed within the inner bore. The retrievable valve assembly includes a rotary valve member having one or more primary flow ports. A fluid flow path is periodically formed by the one or more outer flow ports, the annulus, and the one or more primary flow ports as the rotor rotates.

In some embodiments, the rotary valve member is disposed within the inner bore and the primary flow ports are longitudinally aligned with the outer flow ports. In some embodiments, the retrievable valve assembly further comprises a latching member coupled to the housing and a flexible shaft that couples the latching member to the rotary valve member. In some embodiments, the retrievable valve assembly further comprises a linear adjustment mechanism for moving the rotary valve member from a first position to a second position. In some embodiments, when the rotary valve member is in the second position the primary flow ports are not longitudinally aligned with the outer flow ports. In some embodiments, one or more secondary flow ports are disposed radially through the rotary valve member and when the rotary valve member is in the second position the secondary flow ports are longitudinally aligned with the outer flow ports. In some embodiments, when the retrievable valve assembly is removed from the pulse generator, the pulse generator has a pass-through diameter that is limited by the inner bore of the rotor.

In another embodiment, a pulse generator comprises a housing having a stator coupled thereto. A rotor is rotatably disposed within the housing and having one or more outer flow ports disposed therethrough. An annulus is formed between the rotor and the stator. An inner bore is formed through the rotor. A thrust bearing is coupled to the housing and in contact with the rotor, wherein the thrust bearing longitudinally constrains the rotor. A retrievable valve assembly is rotationally coupled to the rotor and at least partially disposed in the inner bore. The retrievable valve assembly includes a rotary valve member having one or more primary flow ports that restrict flow through the annulus.

In some embodiments, the rotary valve member has a first position wherein the primary flow ports are longitudinally aligned with the outer flow ports. In some embodiments, the rotary valve member can move laterally with the rotor. In some embodiments, the retrievable valve assembly further comprises a linear adjustment mechanism for moving the rotary valve member from the first position to a second position. In some embodiments, when the rotary valve member is in the second position the primary flow ports are not longitudinally aligned with the outer flow ports. In some embodiments, one or more secondary flow ports are disposed through the rotary valve member, wherein when the rotary valve member is in the second position the secondary flow ports are longitudinally aligned with the outer flow ports. In some embodiments, when the retrievable valve assembly is removed from the pulse generator, the pulse generator has a pass-through diameter that is limited by the inner bore of the rotor.

In another embodiment, a method for generating a pressure pulse comprises disposing a retrievable valve assembly at least partially within an inner bore of a rotor that is rotatably coupled to a housing having a stator. The retrievable valve assembly includes a rotary valve member that restricts flow through an annulus between the rotor and the stator. The method further comprises supplying a pressurized fluid to the housing and passing the pressurized fluid through the annulus so that the rotor rotates relative to the housing, wherein as the rotor rotates, the retrievable valve assembly varies the flow of pressurized fluid through the annulus.

In some embodiments, the method further comprises decoupling the retrievable valve assembly from the housing and removing the retrievable valve assembly from the housing to open a pass-through diameter though the housing is limited by the inner bore of the rotor. In some embodiments, the rotary valve member has a first position where one or more primary flow ports in the rotary valve member are longitudinally aligned with one or more outer flow ports through the rotor and as the rotor rotates the primary flow ports are intermittently in fluid communication with the outer flow ports to form a flow path from the annulus to the inner bore of the rotor. In some embodiments, the method further comprises moving the rotary valve member to a second position wherein the primary flow ports are not longitudinally aligned with the outer flow ports. In some embodiments, the method further comprises moving the rotary valve member to a second position wherein one or more secondary flow ports are longitudinally aligned with the outer flow ports. In some embodiments, the primary flow ports have a different shape or arrangement than the secondary flow ports.

BRIEF DESCRIPTION OF THE DRAWINGS

For a more detailed description of the embodiments of the present disclosure, reference will now be made to the accompanying drawings, wherein.

DETAILED DESCRIPTION

Figure 1:
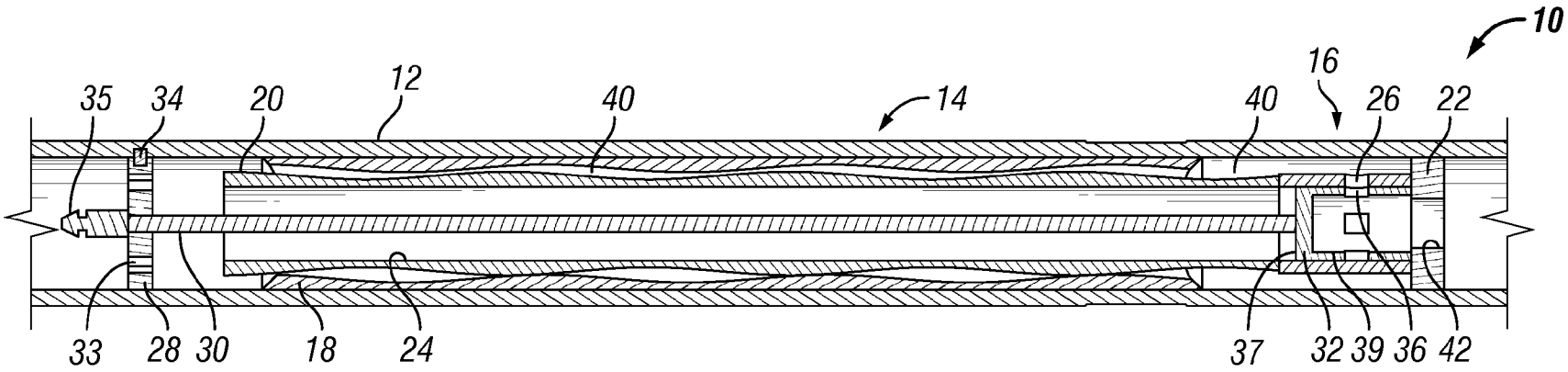
FIG. 1 is partial sectional view of a pulse generator assembly.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

Referring initially to FIG. 1, a pulse generator 10 includes a housing 12, a progressive cavity motor 14, and a retrievable valve assembly 16. The progressive cavity motor 14 includes a stator 18 that is coupled to the inner diameter of the housing 12 and a rotor 20 that is disposed within, and rotatable relative to, the stator 18. The rotor 20 is longitudinally constrained by a thrust bearing 22 that is coupled to the housing 12. Thrust bearing 22 also limits the passage of fluid between the end of the rotor 20 and the thrust bearing 22, thus restricting the flow of fluid out of the annulus 40. The rotor 20 includes an inner bore 24 and one or more outer flow ports 26 that provide fluid communication across the wall of the rotor 20 between the annulus 40 and the inner bore 24. In certain embodiments, progressive cavity motor 14 may be replaced by an alternative rotating motor such as vaned hydraulic motor, an electric motor, or any other type of motor with a rotor that can interface with a retrievable valve assembly 16.

The retrievable valve assembly 16 includes a latching member 28, a flexible shaft 30, and a rotary valve member 32. Retrievable valve assembly 16 is at least partially disposed within the inner bore 24 of the rotor 20. The latching member 28 couples the retrievable valve assembly 16 to the housing 12 via a connection 34. Connection 34 may be a shear pin, shear ring, mechanical latch system, or any other system that longitudinally and rotationally couples the retrievable valve assembly 16 to the housing 12. In certain embodiments, connection 34 may be releasable so that the retrievable valve assembly 16 can be removed from the pulse generator 10.

Removal of the retrievable valve assembly 16 opens the inner bore 24 of rotor 20 so that the pulse generator 10 has a pass-through diameter that is limited by the inner bore 24. The open inner bore 24 allows other tools to be passed through the pulse generator 10 to support operations below the pulse generator 10. Latching member 28 may also include an overshot profile 35 or other feature that aids in the removal of the valve assembly 16 from the pulse generator 10.

Rotary valve member 32 is disposed within the inner bore 24 of rotor 20 and is coupled to the latching member 28 by a flexible shaft 30. In operation, rotor 20, and therefore rotary valve member 32, will oscillate laterally relative to the stator 18 and housing 12. Flexible shaft 30 allows the rotary valve member 32 to oscillate with respect to the latching member 28 but substantially limits rotation of the rotary valve member 32 relative to the latching member 28. Flexible shaft 30 may be constructed from a unitary shaft or by a series of mechanical couplings.

Rotary valve member 32 includes a solid upper end 37 that is coupled to the flexible shaft 30 and a valve body 39 that includes one or more primary flow ports 36. The valve body 39 may be a drum, having a solid upper end 37 and a hollow interior, or may be a substantially solid member with flow ports 36 formed therein. When the pulse generator 10 is assembled, rotary valve member 32 is disposed within the inner bore 24 of the rotor 20 so that the primary flow ports 36 of the rotary valve member 32 are substantially longitudinally aligned with the outer flow ports 26 of the rotor 20.

In operation, pressurized fluid is pumped into the pulse generator 10 through housing 12. Fluid passes through flow ports or openings 33 in latching member 28. Because the solid upper end 37 of the rotary valve member 32 restricts fluid from passing through the inner bore 24 of the rotor 20, the fluid passes through the annulus 40 between the stator 18 and the rotor 20. Fluid moving through annulus 40 causes the rotor 20 to rotate relative to the stator 18 and the rotary valve member 32. As the rotor 20 rotates, the outer flow ports 26 of the rotor 20 periodically align with, and become in fluid communication with, the primary flow ports 36 on the rotary valve member 32. When the outer flow ports 26 are aligned with the inner flow ports 36, fluid can flow from the annulus 40 into the interior of the rotary valve member 32. From the interior of the rotary valve member 32, the fluid moves through a bore 42 in the thrust bearing 22 and out of the pulse generator 10.

The periodic alignment of the outer flow ports 26 and the inner flow ports 36 creates cyclical flow restrictions and flow paths as the flow of fluid is interrupted and allowed by intermittent alignment of the flow ports. As the rotor 20 rotates, a fluid flow path is periodically formed by the outer flow ports 26, the annulus 40, and the primary flow ports 36. This cyclical flow generates pressure pulses in the fluid moving through the pulse generator 10. The characteristics of the pressure pulse, including frequency, amplitude, dwell, and shape of the pressure pulses generated by the pulse generator 10 are dependent on the shape, size and position of both outer flow ports 26 and the primary flow ports 36, as well as the rotational speed of the rotor 20.

For example, the outer flow ports 26 and/or primary flow ports 36 may be sized, shaped, and positioned in a variety of ways in order to create a desired pressure pulse when the pulse generator 10 is operated. FIGS. 2-7 are partial development views of flow ports that may be formed on either the rotary valve member 32 or the rotor 20. For purposes of the following explanation, each embodiment will be described as having primary flow ports disposed on the rotary valve member 32 with one or more equally spaced outer flow ports 26 disposed on the rotor 20, but is it understood that the location of these ports could be reversed.

Figure 2:
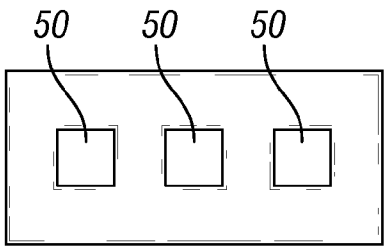
FIG. 2 is a representation of flow ports in one embodiment of a rotary valve member.

In FIG. 2, primary flow ports 36 include a plurality of uniform width slots 50 are substantially evenly spaced about the circumference of either the rotary valve member 32. As rotor 20 rotates and the primary flow ports 36 periodically align with outer flow ports 26 on the rotor 20. This periodic alignment between the primary flow ports 36 and the outer flow ports 26 creates an intermittent flow path between the annulus 40 into the interior of the rotary valve member 32.

If the slots 50 are equally sized and uniformly spaced the series of pressure pulses that are generated in the flow through the pulse generator 10 will have a repeating pattern of pulses at a generally equal magnitude. Increasing or decreasing the width of the slots 50 will similarly change the duration or amplitude of the pressure pulse being generated. Likewise, increasing or decreasing the distance between adjacent slots 50 will result in a pressure pulse frequency of the generated pulse. Thus, in other embodiments the spacing and size of the slots 50 may be varied so that the frequency and amplitude of the generated pulse can be selected for a desired application.

Figure 3:
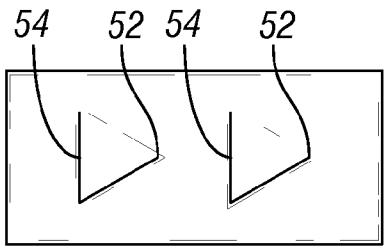
FIG. 3 is a representation of flow ports in one embodiment of an alternate rotary valve member.

In FIG. 3, primary flow ports 36 are shaped with a narrow leading edge 52 and are tapered to a wide trailing edge 54. As an inner flow port 36 passes over an outer flow port 26, the flow area through the aligned ports gradually increases as the width of the port increases from the leading edge 52 to the trailing edge 54. Once the inner flow port 36 passes the outer flow port 26, the generated pulse increases in amplitude as the width of the inner flow port 36 increases and then returns abruptly to zero once the trailing edge 54 passes over the outer flow port 26. The abrupt closing of the inner flow port 36 may cause a pressure spike in the flow of fluid and act as a fluid hammer on the pulse generator 10.

Figure 4:
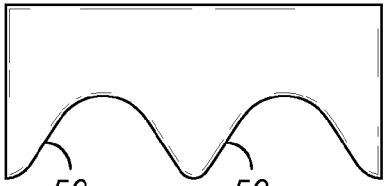
FIG. 4 is a representation of flow ports in one embodiment of an alternate rotary valve member.

In FIG. 4, primary flow ports 36 form a curve 56 that may have a substantially sinusoidal shape. As curve 56 passes over the outer flow ports 26, the amplitude and frequency of the pressure pulses formed will have a similar shape to the curve 56. Curve 56 may also be non-sinusoidal shape and in certain embodiments, may be non-uniform.

Figure 5:
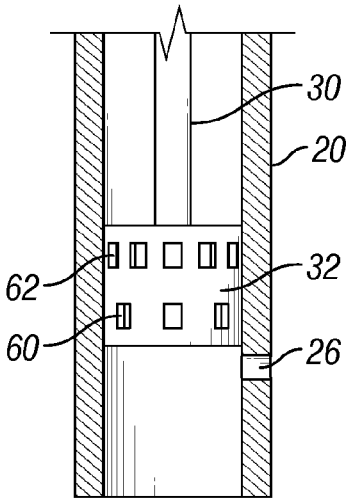
FIG. 5 is a partial sectional view of a pulse generator assembly in a first position.
Figure 6:
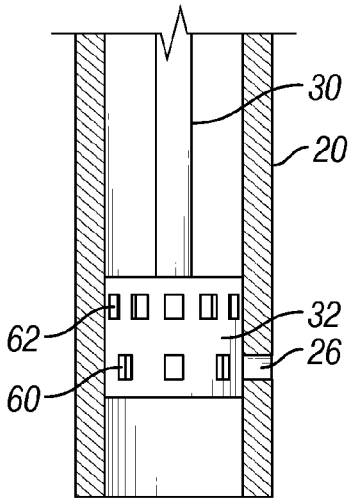
FIG. 6 is a partial sectional view of a pulse generator assembly in a second position.
Figure 7:
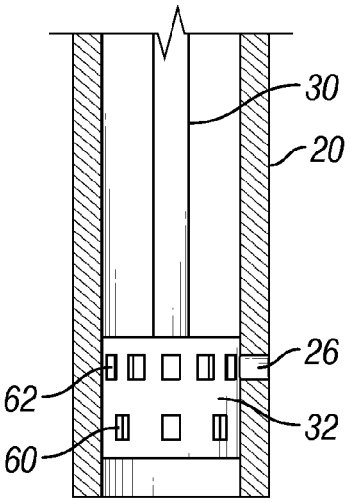
FIG. 7 is a partial sectional view of a pulse generator assembly in a second position.

Referring now to FIGS. 5-7, certain embodiments of pulse generator 10 may have a rotary valve member 32 that can be moved longitudinally relative to the rotor 20. A longitudinally adjustable rotary valve member 32 may include primary flow ports 60 and secondary flow ports 62. In a first position, as shown in FIG. 5, the rotary valve member 32 is positioned so that flow through outer flow ports 26 is not restricted by the rotary valve member 32. In this first position, because the rotary valve member 32 does not restrict the flow through the outer flow ports 26, the pulse generator 10 will not produce any pressure pulses in the flowing fluid.

Referring now to FIG. 6, the rotary valve member 32 is shown in a second position where the primary flow ports 60 are substantially aligned with outer flow ports 26. As the rotor 20 rotates, the primary flow ports 60 periodically align with the outer flow ports 26. When a primary inner flow port 60 is aligned with an outer flow port 26, fluid can pass through the aligned ports and into the rotor 20. As previously discussed, this periodic flow creates pressure pulses in the fluid that moves through the pulse generator 10.

The rotary valve member 32 can also be moved to a third position that is shown in FIG. 7. In the third position, the secondary flow ports 62 are substantially aligned with the outer flow ports 26. As the rotor 20 rotates, the secondary flow ports 62 periodically align with the outer flow ports 26 and allow fluid to pass through the aligned ports and into the rotor 20. As previously discussed, this periodic flow creates pressure pulses in the fluid that moves through the pulse generator 10.

As shown in FIGS. 5-7, the secondary flow ports 62 may be more closely spaced together than the primary flow ports 60. In these embodiments the pressure pulses generated when the rotary valve member 32 is in the third position may have a higher frequency than when the rotary valve member 32 is in the second position. In other embodiments, the primary flow ports 60 may have a different shape or configuration than the secondary flow ports 62 or a rotary valve member 32 may have additional set and/or configurations of flow ports that allow for a variety of pulses, or no pulses at all, to be generated by longitudinally adjusting the position of the rotary valve member 32.

Figure 8:
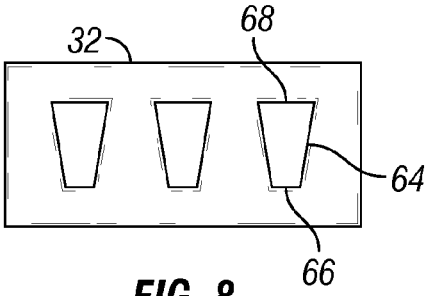
FIG. 8 is a representation of flow ports in one embodiment of an alternate rotary valve member.

For example, referring now to FIG. 8, a rotary valve member 32 may have tapered flow ports 64 that have a width that tapers along the longitudinal height of the valve member. Flow ports 64 have a narrow lower edge 66 and a width that increases to a wider upper edge 68. The tapered flow ports 64 provide a pulse that is adjustable in both duration and amplitude by moving the rotary valve member 32 longitudinally relative to the rotor 20.

Figure 9:
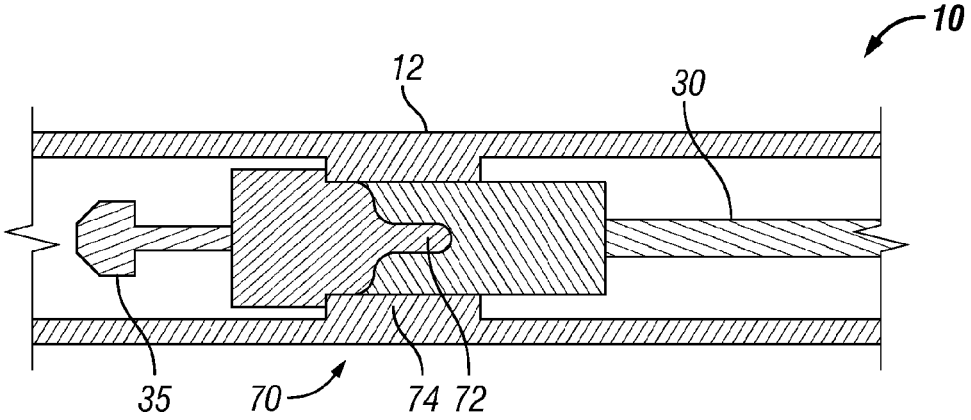
FIG. 9 is a partial sectional view of a linear adjustment mechanism of a pulse generator assembly.

Referring now to FIG. 9, a linear adjustment mechanism 70 is mounted within a housing 12 of a pulse generator 10 and coupled to the flexible shaft 30. The linear adjustment mechanism 70 includes a "mule shoe" landing profile 72 that engages a corresponding slot 74 formed on the housing 12. The linear adjustment mechanism 70 may be a linear indexer that allows the retrievable valve assembly 16 to be moved longitudinally relative to the housing 12. In certain embodiments, the configuration of landing profile 72 and slot 74 is such that each time the linear adjustment mechanism 70 is cycled the longitudinal position of the retrievable valve assembly 16 relative to the housing 12 changes. In other embodiments, a pulse generator 10 may include a linear actuator, mechanical indexer, electric motor, or other system to adjust the longitudinal position of the retrievable valve assembly 16 and/or the rotary valve member 32 within the pulse generator 10.

Figure 10A:
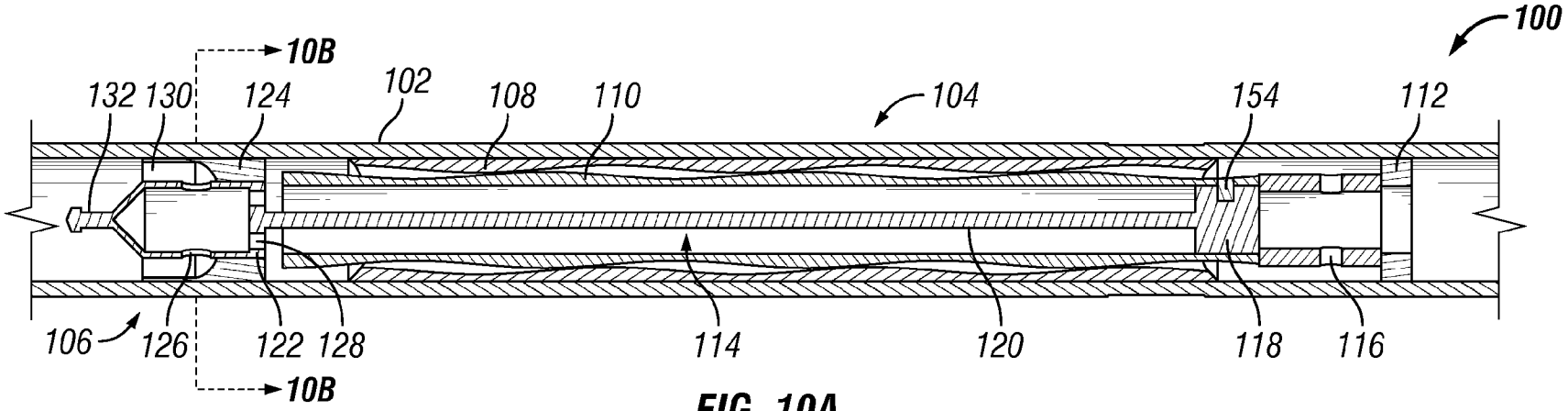
FIG. 10A is a partial sectional view of an alternative embodiment of a pulse generator.
Figure 10B:
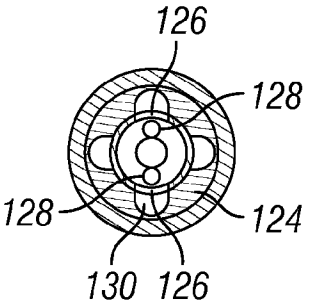
FIG. 10B is a partial sectional view of the pulse generator of FIG. 10 taken along section A-A.

FIGS. 10 and 11 illustrate a pulse generator 100 includes a housing 102, a progressive cavity motor 104, and a retrievable valve assembly 106. The progressive cavity motor 104 includes a stator 108 that is coupled to the inner diameter of the housing 102 and a rotor 110 that is disposed within, and rotatable relative to, the stator 108. The rotor 110 is longitudinally constrained by a thrust bearing 112 that is coupled to the housing 102. Thrust bearing 112 also limits the passage of fluid between the end of the rotor 110 and the thrust bearing 112. The rotor 110 includes an inner bore 114 and one or more outer flow ports 116 that provide fluid communication across the wall of the rotor 110.

Retrievable valve assembly 106 includes a plug 118, a flexible shaft 120, and a valve member 122 that are rotationally coupled to the rotor 110. The valve member 122 is engaged with, and rotates relative to, a valve body 124 that is coupled to the housing 102. The valve member 122 includes radial flow ports 126 and axial flow ports 128. As the valve member 122 rotates, the radial flow ports 126 periodically align with flow channels 130 formed in the valve body 124 to provide a variable flow area for pressurized fluid to flow through the axial flow ports 128 and into the progressive cavity motor 104.

Plug 118 is at least partially disposed within the inner bore 114 of the rotor 110 so as to substantially limit flow through the inner bore 114, thus forcing fluid to flow through the annulus between the stator 108 and the rotor 110. Plug 118 may be coupled to the rotor 110 by a shear pin 134 or some other latching component or mechanism that rotationally couples the plug 118 to the rotor 110 but allows for the retrievable valve assembly 106 to be de-coupled and removed from the pulse generator 100. Removal of the retrievable valve assembly 106 may also be supported by an overshot profile 132 or other feature that allows for the retrievable valve assembly 106 to be engaged by a fishing tool or other device. Removal of the retrievable valve assembly 106 opens the inner bore 114 of rotor 110, thus allowing other tools to be passed through the pulse generator 100.

In operation, pressurized fluid is pumped into the pulse generator 100 through housing 102. Fluid passes through flow channels 130 of the stationary valve body 124 and the radial flow ports 126 and axial flow ports 128 of the rotating valve member 122 and then to the progressive cavity motor 104. The engagement of, or other ports disposed within, the valve body 124 and valve member 122 allows a minimum flow of pressurized fluid to pass to the progressive cavity motor 104 independent of the alignment of the flow channels 130 and the radial flow ports 126, This minimum flow ensures that the progressive cavity motor 104 continuously rotates. Fluid passing to the progressive cavity motor 104 will move through the annulus between the stator 108 and the rotor 110, causing the rotor 110 to rotate. The fluid then passes radially through outer flow ports 116, through the thrust bearing 112 and out of the pulse generator 100.

As previously mentioned, the rotation of the rotor 110 and valve member 122 cause the alignment of the radial flow ports 126 and the stationary flow channels 130 to vary, thus varying the flow of fluid to the progressive cavity motor 104. This cyclical flow creates pressure pulses in the fluid moving through the pulse generator 100. The characteristics, including frequency, amplitude, dwell, and shape of the pressure pulses generated by the pulse generator 100 are dependent on the shape, size and position of both radial flow ports 126 and the flow channels 130, as well as the rotational speed of the rotor 110.

While the disclosure is susceptible to various modifications and alternative forms, specific embodiments thereof are shown by way of example in the drawings and description. It should be understood, however, that the drawings and detailed description thereto are not intended to limit the disclosure to the particular form disclosed, but on the contrary, the intention is to cover all modifications, equivalents and alternatives falling within the spirit and scope of the present disclosure.

What is claimed is:

1. A pulse generator comprising:

a stator coupled to a housing;

a rotor rotatably disposed within the housing;

an annulus formed between the rotor and the stator;

an inner bore formed through the rotor;

one or more outer flow ports that provide fluid communication between the annulus and the inner bore; and a retrievable valve assembly rotationally coupled to the rotor and at least partially disposed within the inner bore, wherein the retrievable valve assembly includes a rotary valve member having one or more primary flow ports, and a linear adjustment mechanism for moving the rotary valve member from a first position to a second position;

wherein a fluid flow path is periodically formed by the one or more outer flow ports, the annulus, and the one or more primary flow ports as the rotor rotates.

2. The pulse generator of claim 1, wherein the rotary valve member is disposed within the inner bore and the primary flow ports are longitudinally aligned with the outer flow ports.

3. The pulse generator of claim 1, wherein the retrievable valve assembly further comprises a latching member coupled to the housing and a flexible shaft that couples the latching member to the rotary valve member.

4. The pulse generator of claim 1, wherein when the rotary valve member is in the second position the primary flow ports are not longitudinally aligned with the outer flow ports.

5. The pulse generator of claim 1, further comprising one or more secondary flow ports disposed radially through the rotary valve member, wherein when the rotary valve member is in the second position the secondary flow ports are longitudinally aligned with the outer flow ports.

6. The pulse generator of claim 1, wherein when the retrievable valve assembly is removed from the pulse generator, the pulse generator has a pass-through diameter that is limited by the inner bore of the rotor.

7. A pulse generator comprising:

a housing having a stator coupled thereto;

a rotor rotatably disposed within the housing and having one or more outer flow ports disposed therethrough;

an annulus formed between the rotor and the stator;

an inner bore formed through the rotor;

a thrust bearing coupled to the housing and in contact with the rotor, wherein the thrust bearing longitudinally constrains the rotor; and a retrievable valve assembly rotationally coupled to the rotor and at least partially disposed in the inner bore, wherein the retrievable valve assembly includes a rotary valve member having one or more primary flow ports that restrict flow through the annulus.

8. The pulse generator of claim 7, wherein the rotary valve member has a first position wherein the primary flow ports are longitudinally aligned with the outer flow ports.

9. The pulse generator of claim 8, wherein the rotary valve member can move laterally with the rotor.

10. The pulse generator of claim 8, wherein the retrievable valve assembly further comprises a linear adjustment mechanism for moving the rotary valve member from the first position to a second position.

11. The pulse generator of claim 10, wherein when the rotary valve member is in the second position the primary flow ports are not longitudinally aligned with the outer flow ports.

12. The pulse generator of claim 10, further comprising one or more secondary flow ports disposed through the rotary valve member, wherein when the rotary valve member is in the second position the secondary flow ports are longitudinally aligned with the outer flow ports.

13. The pulse generator of claim 10, wherein when the retrievable valve assembly is removed from the pulse generator, the pulse generator has a pass-through diameter that is limited by the inner bore of the rotor.

14. A method for generating a pressure pulse comprising:

disposing a retrievable valve assembly at least partially within an inner bore of a rotor that is rotatably coupled to a housing having a stator, wherein the retrievable valve assembly includes a rotary valve member that restricts flow through an annulus between the rotor and the stator, and wherein the rotary valve member has a first position where one or more primary flow ports in the rotary valve member are longitudinally aligned with one or more outer flow ports through the rotor and as the rotor rotates the primary flow ports are intermittently in fluid communication with the outer flow ports to form a flow path from the annulus to the inner bore of the rotor;

supplying a pressurized fluid to the housing; and passing the pressurized fluid through the annulus so that the rotor rotates relative to the housing, wherein as the rotor rotates, the retrievable valve assembly varies the flow of pressurized fluid through the annulus.

15. The method of claim 14, further comprising:

decoupling the retrievable valve assembly from the housing; and removing the retrievable valve assembly from the housing to open a pass-through diameter though the housing is limited by the inner bore of the rotor.

16. The method of claim 14, further comprising moving the rotary valve member to a second position wherein the primary flow ports are not longitudinally aligned with the outer flow ports.

17. The method of claim 14, further comprising moving the rotary valve member to a second position wherein one or more secondary flow ports are longitudinally aligned with the outer flow ports.

18. The method of claim 17, wherein the primary flow ports have a different shape or arrangement than the secondary flow ports.

* * * * *